US007781389B2

(12) United States Patent
Schmiedel et al.

(10) Patent No.: US 7,781,389 B2
(45) Date of Patent: Aug. 24, 2010

(54) PHTHALIMIDOPEROXYALKANOIC ACID-CONTAINING DETERGENT OR CLEANING AGENT

(75) Inventors: Peter Schmiedel, Duesseldorf (DE); Elke Scholl, Duesseldorf (DE); Wolfgang Von Rybinski, Duesseldorf (DE); Christian Rosenkranz, Duesseldorf (DE); Soeren Hoelsken, Duesseldorf (DE); Bernhard Guckenbiehl, Cologne (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 12/569,212

(22) Filed: Sep. 29, 2009

(65) Prior Publication Data

US 2010/0081603 A1 Apr. 1, 2010

Related U.S. Application Data

(63) Continuation of application No. PCT/EP2008/053003, filed on Mar. 13, 2008.

(30) Foreign Application Priority Data

Apr. 4, 2007 (DE) ..... 10 2007 016 709
Nov. 27, 2007 (DE) ..... 10 2007 057 351

(51) Int. Cl.
*C11D 3/395* (2006.01)

(52) U.S. Cl. ..... 510/287; 510/276; 510/277; 510/318; 510/319; 510/367; 510/398; 510/401; 510/467; 510/477; 510/485; 510/508

(58) Field of Classification Search ..... 510/276, 510/277, 287, 318, 319, 367, 398, 401, 467, 510/477, 485, 508
See application file for complete search history.

(56) References Cited

U.S. PATENT DOCUMENTS

| | | | | |
|---|---|---|---|---|
| 5,296,156 | A * | 3/1994 | Ploumen et al. | 510/375 |
| 7,179,778 | B2 | 2/2007 | Weber | |
| 2002/0122776 | A1 * | 9/2002 | Joiner et al. | 424/53 |
| 2004/0033921 | A1 | 2/2004 | Dasque et al. | |
| 2005/0075258 | A1 * | 4/2005 | Kessler et al. | 510/221 |
| 2005/0113271 | A1 * | 5/2005 | Pegelow et al. | 510/220 |
| 2006/0116309 | A1 * | 6/2006 | Lambotte et al. | 510/302 |
| 2007/0054829 | A1 * | 3/2007 | Gentschev et al. | 510/302 |
| 2009/0048140 | A1 | 2/2009 | Schmiedel et al. | |
| 2010/0024133 | A1 | 2/2010 | Hatzelt et al. | |
| 2010/0029540 | A1 | 2/2010 | Hatzelt et al. | |
| 2010/0048447 | A1 | 2/2010 | Hatzelt et al. | |

FOREIGN PATENT DOCUMENTS

| | | | |
|---|---|---|---|
| EP | 0 852 259 | A1 | 7/1998 |
| EP | 1 717 302 | A1 | 11/2006 |
| GB | 2 323 371 | A | 9/1998 |
| WO | WO 2004/053038 | A1 | 6/2004 |
| WO | WO 2006/120405 | A1 | 11/2006 |

OTHER PUBLICATIONS

International Search Report for Priority Application PCT/EP2008/053003.

* cited by examiner

*Primary Examiner*—Charles I Boyer
(74) *Attorney, Agent, or Firm*—RatnerPrestia

(57) ABSTRACT

The invention proposes a bleaching agent-containing washing or cleaning agent that contains a particulate phthalimidoperoxyalkanoic acid and an active substance selected from the group encompassing Zn ions, benzotriazole, nitrate ions, phosphonocarboxylic acids, phosphonic acids, phosphates, polyaspartic acids, fatty amines, surfactants having nitrogen-containing head groups, and mixtures thereof.

20 Claims, No Drawings

PHTHALIMIDOPEROXYALKANOIC ACID-CONTAINING DETERGENT OR CLEANING AGENT

CROSS-REFERENCE TO RELATED APPLICATIONS

This application is a continuation under 35 U.S.C. §§120 and 365(c) of International Application PCT/EP2008/053003, filed on Mar. 13, 2008, and published as WO 2008/122478 on Oct. 16, 2008. This application also claims priority under 35 U.S.C. §119 from DE 10 2007016709.3 filed on Apr. 4, 2007, and DE 10 2007057351.2, filed Nov. 27, 2007. The disclosures of PCT/EP2008/053003, DE 10 2007016709.3, and DE 10 2007057351.2 are incorporated herein by reference in their entirety for all purposes.

FIELD OF THE INVENTION

The present patent application relates to washing or cleaning agents that contain peracid particles and corrosion inhibitor.

BACKGROUND OF THE RELATED ART

Phthalimidoperoxyalkanoic acids, for example 6-phthalimidoperoxyhexanoic acid (PAP), are highly efficient bleaching agents. Their use in both solid and liquid washing or cleaning agents has been repeatedly proposed.

When phthalimidoperoxyalkanoic acid-containing washing-agent formulations are used in commercially usual washing machines, however, traces of corrosion can be found after approximately at least 50 washing cycles, these traces being found often on the mounts of the heating elements and on the heating elements themselves, largely regardless of whether nickel-plated material is involved. With nickel-plated heating rods in particular, it may happen that firstly the Ni layer of the nickel-plated heating elements is removed directly at the contact point with the mount made of chromium steel or stainless steel, for example Nirosta® 4301. A brownish "halo", which presumably is rust, can form around this point. Rust likewise often occurs at the heating-element mount in the immediate vicinity of the contact point. The heating element itself can be covered with small brownish discolorations that, however, are normally not anywhere near as pronounced at other sites as they are at the contact point with the mount. When such corrosion phenomena occur, premature failure of the heating element must be expected. The same corrosion effect also occurs analogously in automatic dishwashers.

In EDX measurements on steel pieces that have been treated with phthalimidoperoxyalkanoic acid-free and, for comparison, with phthalimidoperoxyalkanoic acid-containing washing liquor, nitrogen can be detected on the metal surface after treatment with a phthalimidoperoxyalkanoic acid-containing bath. The conclusion resulting from this is that phthalimidoperoxyalkanoic acids have an affinity for the metal surface, and adsorb onto it.

The corrosion potential between nickel and steel in a phthalimidoperoxyalkanoic acid-containing washing bath is time-dependent. This change in potential over time can be attributed to breakdown of the phthalimidoperoxyalkanoic acid.

With no intention to be confined to this theory, this adsorption of phthalimidoperoxyalkanoic acid onto the metal surface is possibly the cause of the corrosive effect, since in this context, the phthalimidoperoxyalkanoic acid (constituting an oxidizing agent) is present at a high concentration directly at the surface of the cathode.

It has been found, surprisingly, that this problem can in no way be solved by the use of any known corrosion inhibitors.

BRIEF SUMMARY OF THE INVENTION

The subject of the present invention, which intends to create a remedy here, is a bleaching agent-containing washing or cleaning agent containing a particulate phthalimidoperoxyalkanoic acid, the agent furthermore comprising an active substance selected from the group encompassing Zn ions, benzotriazole, nitrate ions, phosphonocarboxylic acids, phosphonic acids, phosphates, polyaspartic acids, fatty amines, surfactants having nitrogen-containing head groups, and mixtures thereof. Instead of the aforesaid acids or in addition thereto, it is also possible to use salts thereof, in particular ammonium, alkylammonium, hydroxyalkylammonium, and/or alkali salts.

The combined use of polycarboxylates together with at least one of the aforesaid active substances, in particular with phosphonic and/or phosphonocarboxylic acids and/or salts thereof, brings about (against the background discussed above) an extremely outstanding suppression of corrosion; a preferred embodiment of the invention therefore relates to an agent composed according to the present invention that additionally contains polycarboxylate.

DETAILED DESCRIPTION OF CERTAIN EMBODIMENTS OF THE INVENTION

Zn ions are introduced in the form of water-soluble Zn salts, for example zinc acetate, zinc nitrate, and/or zinc sulfate. In preferred embodiments of the invention, these are combined with at least one other of the aforesaid active substances, wherein in the case of the aforesaid acids, the combination can also be produced by the use of the corresponding zinc salts. The concentration of the zinc salt in the washing or cleaning bath is by preference in the range from 1 ppm to 500 ppm, in particular from 10 ppm to 200 ppm. An agent according to the present invention contains by preference 0.05 wt % to 4 wt %, in particular 0.2 wt % to 2 wt %, zinc salt.

Nitrate can be introduced into the agent according to the present invention, for example, via the aforesaid zinc nitrate or as an alkali salt, for example sodium nitrate.

Phosphonocarboxylic acids can comprise one or more carboxylic acid functionalities. They can moreover contain further functionalities, for example nitrogen oxide, amino, and/or hydroxyl groups. Included among preferred phosphonocarboxylic acids are 2-hydroxyphosphonoacetic acid and 2-phosphonobutane-1,2,4-tricarboxylic acid. By preference up to 10 wt %, in particular 2 wt % to 4 wt %, phosphonocarboxylic acid is contained in agents according to the present invention.

The usable phosphonic acids can also contain further functionalities, for example nitrogen oxide, amino, and/or hydroxyl groups. Included among the preferred phosphonic acids are (1-hydroxyethylidene)diphosphonic acid, aminotri(methylenephosphonic acid), ethylenediaminetetra(methylenephosphonic acid), and/or diethylenetriaminepenta(methylenephosphonic acid), and the nitrogen oxides of the aforesaid nitrogen-containing compounds. By preference up to 10 wt %, in particular 2 wt % to 4 wt %, phosphonic acid is contained in agents according to the present invention. Suitable phosphonic acids, mixtures of phosphonic acids, and/or salts thereof are commercially obtainable, for example under the designation Cublen® MA of the Zschimmer & Schwarz company (Germany) or under the designation Aquacid® 1084 EX of the Aquapharm Chemical company (India).

Included among the preferred phosphates are orthophosphate, pyrophosphate, triphosphate, and polyphosphates. They comprise usual counter-cations, by preference alkali metal ions such as sodium and/or potassium. Phosphates are contained in agents according to the present invention in quantities by preference up to 40 wt %, in particular from 2 wt % to 20 wt %. Polyaspartic acid is commercially obtainable, for example, under the designation Baypure® CX.

Fatty amines are nitrogen analogs of the fatty alcohols. They are manufactured industrially by ammonolysis of fatty alcohols, or from fatty acids via the fatty acid nitrile stage. Depending on the reaction conditions selected, hydrogenation of the fatty acid nitriles leads to the primary fatty amine or to symmetrical secondary and tertiary fatty amines.

Among the surfactants having nitrogen-containing head groups, trimethyl fatty alkylammonium compounds and the alkyl sarcosinates are particularly preferred.

In solid agents according to the present invention, besides the aforesaid substance classes, the use of mercapto compounds such as mercaptobenzothiazole is also suitable. These can be used in liquid agents if the agent is made up of multiple sub-compositions stored separately from one another, and if they are present in a sub-composition that is free of phthalimidoperoxyalkanoic acid.

If the agent according to the present invention contains 0.05 wt % to 10 wt %, by preference 0.1 wt % to 5 wt %, advantageously 0.2 wt % to 4 wt %, in particular 0.3 wt % to 3 wt %, of an aforesaid active substance, the "wt %" indication being based on the entire agent, this corresponds to particularly preferred embodiments.

The concentration of the aforesaid active substance in the washing bath is by preference at least 2 ppm, is advantageously in the range from 5 ppm to 300 ppm, with further advantage in the range from 10 ppm to 250 ppm, in particular in the range from 20 ppm to 200 ppm.

Besides the active substance recited, in preferred embodiments an agent according to the present invention can additionally contain polycarboxylate. Polycarboxylates are contained in the agent by preference in quantities from 0.5 wt % to 15 wt %, particularly preferably 1 wt % to 10 wt %, advantageously 2 wt % to 8 wt %, in particular 3 wt % to 6 wt %, "wt %" being based on the entire agent.

The concentrations of the polycarboxylates in the washing bath are by preference at least 40 ppm, advantageously in the range from 50 ppm to 500 ppm, with further advantage in the range from 100 ppm to 400 ppm, in particular in the range from 150 ppm to 300 ppm.

Suitable polycarboxylates are, for example, the alkali metal salts of polyacrylic acid or polymethacrylic acid, for example those having a weight-averaged molar weight $M_w$ from 500 to 70,000 g/mol, those polycarboxylates that have a low molar weight $M_w$, by preference below 40,000 g/mol, being especially preferred.

According to a preferred embodiment of the invention, those polycarboxylates that have weight-averaged molar weights $M_w$ in the range below 40,000 g/mol, advantageously below 30,000 g/mol, by preference below 20,000, preferably in the range from 1000 to 15,000 g/mol, in particular in the range from 2000 to 10,000 g/mol, are preferred.

The molar weights indicated for the polycarboxylates are, for purposes of this document, weight-averaged molar weights $M_w$ of the respective acid form that were determined in principle by means of gel permeation chromatography (GPC), a UV detector having been used. The measurement was performed against an external polyacrylic acid standard that yields realistic molecular weight values because of its structural affinity with the polymers being investigated. These indications deviate considerably from the molecular weight indications in which polystyrenesulfonic acids are used as a standard. The molar weights measured against polystyrenesulfonic acids are usually much higher than the molar weights indicated in this document.

The term "polycarboxylates" also encompasses copolymeric polycarboxylates, in particular those of acrylic acid with methacrylic acid and of acrylic acid or methacrylic acid with maleic acid. Copolymers of acrylic acid with maleic acid that contain 50 to 90 wt % acrylic acid and 50 to 10 wt % maleic acid are, for example, suitable.

In order to improve water solubility, the polycarboxylates can also contain allylsulfonic acids, for example allyloxybenzenesulfonic acid and methallylsulfonic acid, as a monomer.

Also usable are biodegradable polymers made up of more than two different monomer units, which contain as monomers salts of acrylic acid and maleic acid and, for example, vinyl alcohol or vinyl alcohol derivatives or, as monomers, salts of acrylic acid and of 2-alkylallylsulfonic acid, as well as, for example, sugar derivatives.

It is particularly preferred if polyacrylates (i.e. homopolymers and/or copolymers of acrylic acid) are contained as polycarboxylates in the agent according to the present invention, by preference those having weight-averaged molar weights $M_w$ in the range below 40,000 g/mol, advantageously below 30,000 g/mol, by preference below 20,000, preferably in the range from 1000 to 15,000 g/mol, in particular in the range from 2000 to 10,000 g/mol, the molar weights having been determined by gel permeation chromatography as indicated above. This corresponds to a particularly preferred embodiment. Suitable polyacrylates are commercially obtainable, for example Sokalan® PA 25 CI or Sokalan® PA 30 CI, both commercial products of BASF AG.

The phthalimidoperoxyalkanoic acid content in the agents according to the present invention is by preference 0.5 wt % to 25 wt %, in particular 1 wt % to 20 wt %, and particularly preferably 1.5 to 15 wt %, "wt %" based on the entire agent.

The concentration of phthalimidoperoxyalkanoic acid in the washing bath is by preference at least 5 ppm, but is advantageously in the range from 10 ppm to 400 ppm, by preference in the range from 20 ppm to 300 ppm, in particular in the range from 30 ppm to 200 ppm.

The phthalimidoperoxyalkanoic acid can have been prepared in known fashion in particle form, using inert carrier materials; it is used by preference in encased form. Possibilities are, for example, 4-phthalimidoperoxybutanoic acid, 5-phthalimitoperoxypentanoic acid, 6-phthalimidoperoxyhexanoic acid, 7-phthalimidoperoxyheptanoic acid, N,N'-terephthaloyldi-6-aminoperoxyhexanoic acid, and mixtures thereof. Included among the preferred phthalimidoperoxyalkanoic acids is 6-phthalimidoperoxyhexanoic acid (PAP).

If desired, the phthalimidoperoxyalkanoic acid particles contained in the agents according to the present invention can be coated. It is important in this context that the coating material release the encased peroxycarboxylic acid under the application conditions of the agent (at higher temperature, a pH that is changing due to dilution by water, or the like). A preferred coating material is one that is made up at least in part of saturated fatty acid. The chain length of the fatty acid is preferably greater than $C_{12}$; stearic acid is particularly preferred. A further preferred coating material is paraffin.

An encasing material, if present, is preferably applied onto the particulate peroxycarboxylic acid in quantities such that the encased peroxycarboxylic acid particles are made up of 1 wt % to 50 wt % encasing material. The diameter of the encased peroxycarboxylic acid particles is by preference in the range from 100 μm to 4000 μm; this involves proceeding from correspondingly more-finely particulate peroxycarboxylic acid material, and covering it with the encasing material. It is preferable to proceed in such a way that a fluidized bed of the peroxycarboxylic acid particles to be encased is sprayed with a solution or slurry, by preference an aqueous solution, or a melt of the encasing material; the solvent or slurrying material (if present), by preference water, is removed by evaporation or the melted encasing material is solidified by cooling; and the encased peroxycarboxylic acid particles are discharged from the fluidized bed in a manner that is usual in principle. The aforementioned encasing with fatty acids and/or paraffin is preferably a melt coating.

In addition to the aforesaid active substances and the peroxycarboxylic acid particles, a washing or cleaning agent according to the present invention can contain all ingredients usual in such agents, for example surfactant, builders, enzymes, and further adjuvants such as soil repellents, thickening agents, dyes and fragrances, or the like.

In a preferred embodiment, it contains nonionic surfactants as well as, if applicable, anionic surfactants, cationic surfactants and/or amphoteric surfactants.

Surfactants of the sulfonate type, alk(en)yl sulfates, alkoxylated alk(en)yl sulfates, estersulfonates, and/or soaps are preferably used as anionic surfactants.

Possibilities as surfactants of the sulfonate type are, by preference, $C_{9-13}$ alkylbenzenesulfonates, olefinsulfonates, i.e. mixtures of alkene- and hydroxyalkanesulfonates, and disulfonates, for example such as those obtained from $C_{12-18}$ monoolefins having an end-located or internal double bond, by sulfonation with gaseous sulfur trioxide and subsequent alkaline or acid hydrolysis of the sulfonation products.

Preferred alk(en)yl sulfates are the alkali, and in particular sodium, salts of the sulfuric acid semi-esters of the $C_{12}$ to $C_{18}$ fatty alcohols, for example from coconut fatty alcohol, tallow fatty alcohol, lauryl, myristyl, cetyl, or stearyl alcohol, or of the $C_{10}$ to $C_{20}$ oxo alcohols, and those semi-esters of secondary alcohols of that chain length. Additionally preferred are alk(en)yl sulfates of the aforesaid chain length that contain a synthetic straight-chain alkyl radical produced on a petrochemical basis. For purposes of washing technology, the $C_{12}$ to $C_{16}$ alkyl sulfates and $C_{12}$ to $C_{15}$ alkyl sulfates, as well as $C_{14}$ to $C_{15}$ alkyl sulfates, are preferred. 2,3-Alkyl sulfates that can be obtained, for example, as commercial products of the Shell Oil Company under the name DAN®, are also suitable anionic surfactants.

The sulfuric acid monoesters of straight-chain or branched $C_{7-21}$ alcohols ethoxylated with 1 to 6 mol ethylene oxide, such as 2-methyl-branched $C_{9-11}$ alcohols having an average of 3.5 mol ethylene oxide (EO) or $C_{12-15}$ fatty alcohols having 1 to 4 EO, are also suitable. Because of their high foaming characteristics they are used in washing agents only in relatively small quantities, for example in quantities from 0 to 5 wt %.

The esters of α-sulfo fatty acids (estersulfonates), e.g., the α-sulfonated methyl esters of hydrogenated coconut, palm-kernel, or tallow fatty acids, are also suitable.

Further optional surfactant ingredients that are appropriate are soaps. Saturated fatty acid soaps such as the salts of lauric acid, myristic acid, palmitic acid, stearic acid, hydrogenated erucic acid, and behenic acid, as well as soap mixtures derived in particular from natural fatty acids, for example coconut, palm-kernel, or tallow fatty acids, are suitable. Those soap mixtures that are made up of 50 to 100 wt % saturated $C_{12}$ to $C_{24}$ fatty acid soaps and 0 to 50 wt % oleic acid soap are particularly preferred.

A further class of anionic surfactants is the class of ethercarboxylic acids accessible by reacting fatty alcohol ethoxylates with sodium chloroacetate in the presence of basic catalysts. They have the general formula $RO—(CH_2—CH_2—O)_p—CH_2—COOH$, where $R=C_1$ to $C_{18}$ $l$ and $p$=0.1 to 20. Ethercarboxylic acids are insensitive to water hardness and exhibit outstanding surfactant properties.

Cationically active surfactants contain the high-molecular-weight hydrophobic residue governing surface activity, in the cation, upon dissociation in aqueous solution. The most important representatives of the cationic surfactants are the quaternary ammonium compounds of the general formula: $(R^1R^2R^3R^4N^+)\ X^-$. Here $R_1$ denotes $C_1$ to $C_6$ alk(en)yl, $R^2$ to $R^4$, mutually independently, denote $C_nH_{2n+1-p-x}$-$(Y^1(CO)R^5)_p$-$(Y^2H)_x$, wherein n denotes integers without 0, and p and x denote integers or 0. $Y^1$ and $Y^2$, mutually independently, denote O, N, or NH. $R^5$ denotes a $C_3$ to $C_{23}$ alk(en)yl chain. X is a counterion that is preferably selected from the group of the alkyl sulfates and alkyl carbonates. Cationic surfactants in which the nitrogen group is substituted with two long acyl residues and two short alk(en)yl residues are particularly preferred.

Amphoteric or ampholytic surfactants comprise multiple functional groups that can ionize in aqueous solution and, depending on the conditions of the medium, impart an anionic or cationic character to the compounds. The amphoteric surfactants form internal salts In the vicinity of the isoelectric point, with the result that they can become poorly soluble or insoluble in water. Amphoteric surfactants are subdivided into ampholytes and betaines, the latter being present in solution as zwitterions. Ampholytes are amphoteric electrolytes, i.e., compounds that possess both acid and basic hydrophilic groups and thus behave in either acid or basic fashion, depending on conditions. "Betaines" refers to compounds having the atomic grouping $R_3N^+—CH_2—COO^-$, which exhibit typical properties of zwitterions.

Alkoxylated and/or propoxylated, in particular primary alcohols having by preference 8 to 18 carbon atoms and an average of 1 to 12 mol ethylene oxide (EO) and/or 1 to 10 mol propylene oxide (PO) per mol of alcohol, are used by preference as nonionic surfactants. Particularly preferred are $C_8$ to $C_{16}$ alcohol alkoxylates, advantageously ethoxylated and/or propoxylated $C_{10}$ to $C_{15}$ alcohol alkoxylates, in particular $C_{12}$ to $C_{14}$ alcohol alkoxylates, having a degree of ethoxylation between 2 and 10, preferably between 3 and 8, and/or a degree of propoxylation between 1 and 6, preferably between 1.5 and 5. The degrees of ethoxylation and propoxylation that are indicated represent statistical averages, which for a specific product may be a whole or fractional number. Preferred alcohol ethyoxylates and propoxylates exhibit a restricted homolog distribution (=narrow range ethoxylates/propoxylates, NRE/NRP). In addition to these nonionic surfactants, fatty alcohols having more than 12 EO can also be used. Examples of these are (tallow) fatty alcohols having 14 EO, 16, EO, 20 EO, 25 E0, 30 EO, or 40 EO.

Also usable as further nonionic surfactants are alkyl glycosides of the general formula $RO(G)_x$, for example as compounds, particularly with anionic surfactants, in which R denotes a primary straight-chain or methyl-branched (in particular methyl-branched in the 2-position) aliphatic radical having 8 to 22, by preference 12 to 18 carbon atoms; and G is the symbol denoting a glycose unit having 5 or 6 carbon atoms, preferably glucose. The degree of oligomerization x, which indicates the distribution of monoglycosides and oligoglycosides, is any number between 1 and 10; by preference, x is between 1.1 and 1.4.

A further class of nonionic surfactants used in preferred fashion, which are used either as the only nonionic surfactant or in combination with other nonionic surfactants, in particular together with alkoxylated fatty alcohols and/or alkyl glycosides, are alkoxylated, preferably ethoxylated or ethoxylated and propoxylated, fatty acid alkyl esters, by preference having 1 to 4 carbon atoms in the alkyl chain, in particular fatty acid methyl esters. $C_{12}$ to $C_{18}$ fatty acid methyl esters having an average of 3 to 15 EO, in particular an average of 5 to 12 EO, are particularly preferred.

Nonionic surfactants of the amine oxide type, for example N-cocalkyl-N,N-dimethylamine oxide and N-tallowalkyl-N,N-dihydroxyethylamine oxide, and the fatty acid alkanolamides, can also be suitable. The quantity of these nonionic surfactants is by preference no more than that of the ethoxylated fatty alcohols, in particular no more than half thereof.

Further surfactants that are possible are so-called Gemini surfactants. These are understood in general as those compounds that possess two hydrophilic groups and two hydrophobic groups per molecule. These groups are usually separated from one another by a so-called "spacer." This spacer is usually a carbon chain, which should be sufficiently long that the hydrophilic groups have enough spacing that they can act mutually independently. Surfactants of this kind are generally characterized by an unusually low critical micelle concentration, and by the ability to greatly reduce the surface tension of water. In exceptional cases, however, the expression "Gemini surfactants" is understood to mean not only dimeric but also trimeric surfactants.

Suitable Gemini surfactants are, for example, sulfated hydroxy mixed ethers or dimeralcohol bis- and trimeralcohol trisulfates and ether sulfates. End-capped dimeric and trimeric mixed ethers are characterized in particular by their bi- and multifunctionality. For example, the aforesaid end-capped surfactants possess good wetting properties and are also low-foaming, so that they are particularly suitable for use in automatic washing or cleaning methods. Gemini polyhydroxy fatty acid amides or polypolyhydroxy fatty acid amides can, however, also be used.

The quantity of surfactants contained in the agents according to the present invention is by preference 0.1 wt % to 50 wt %, in particular 10 wt % to 40 wt %, and particularly preferably 20 wt % to 70 wt %. Mixtures of anionic and nonionic surfactants are preferably used.

Suitable enzymes are, in particular, those in the classes of hydrolases, such as proteases, esterases, lipases or lipolytically active enzymes, amylases, cellulases and other glycosyl hydrolases, and mixtures of the aforesaid enzymes. All these hydrolases contribute, in the laundry, to the removal of stains such as protein-, fat-, or starch-containing stains, and graying. Cellulases and other glycosyl hydrolases can contribute to color retention and to enhanced textile softness by removing pilling and microfibrils. Oxidoreductases can also be used for bleaching and to inhibit color transfer.

Enzymatic active substances obtained from bacterial strains or fungi, such as *Bacillus subtilis, Bacillus licheniformis*, Streptomyceus griseus, and Humicola insolens, are particularly suitable. Proteases of the subtilisin type, and in particular proteases obtained from *Bacillus lentus*, are preferably used. Enzyme mixtures, for example of protease and amylase or protease and lipase or lipolytically active enzymes, or protease and cellulase, or of cellulase and lipase or lipolytically active enzymes, or of protease, amylase, and lipase or lipolytically active enzymes, or protease, lipase or lipolytically active enzymes, and cellulase, but in particular protease- and/or lipase-containing mixtures or mixtures with lipolytically active enzymes, are of particular interest in this context. Examples of such lipolytically active enzymes are the known cutinases. Peroxidases or oxidases have also proven suitable in certain cases. The suitable amylases include, in particular, α-amylases, isoamylases, pullulanases, and pectinases. Cellobiohydrolases, endoglucanases, and β-glucosidases, which are also called cellobiases, and mixtures thereof, are preferably used as cellulases. Because the different types of cellulase differ in terms of their CMCase and avicelase activities, the desired activities can be adjusted by means of controlled mixtures of the cellulases.

The proportion of enzymes or enzyme mixtures can be equal, for example, to approximately 0.1 to 5 wt %, by preference 0.1 to approximately 3 wt %. They are preferably used in agents according to the present invention prepared in particle form.

Builders, cobuilders, soil repellents, alkaline salts, as well as foam inhibitors, complexing agents, enzyme stabilizers, graying inhibitors, optical brighteners, and UV absorbers, can be contained as further washing-agent constituents.

A finely crystalline synthetic zeolite containing bound water can be used as a builder, by preference zeolite A and/or zeolite P. Zeolite MAP® (commercial product of the Crosfield Co.) is particularly preferred, for example, as zeolite P. Also suitable, however, are zeolite X as well as mixtures of A, X, and/or P. Also of particular interest is a co-crystallized sodium/potassium aluminum silicate of zeolite X and zeolite A that is commercially obtainable as VEGOBOND AX® (commercial product of the Condea company). The zeolite can preferably be used as a spray-dried powder In the event the zeolite is used as a suspension, it can contain small additions of nonionic surfactants as stabilizers, for example 1 to 3 wt %, based on the zeolite, of ethoxylated $C_{12}$ to $C_{18}$ fatty alcohols having 2 to 5 ethylene oxide groups, $C_{12}$ to $C_{14}$ fatty alcohols having 4 to 5 ethylene oxide groups, or ethoxylated isotridecanols. Suitable zeolites exhibit an average particle size of less than 10 μm (volume distribution; measurement method: Coulter Counter), and contain by preference 18 to 22 wt %, in particular 20 to 22 wt %, bound water. In addition, phosphates can also be used as builder substances.

Suitable substitutes or partial substitutes for phosphates and zeolites are crystalline, sheet-form sodium silicates of the general formula $NaMSi_xO_{2x+1}.yH_2O$, where M denotes sodium or hydrogen, x is a number from 1.9 to 4, and y is a number from 0 to 20, and preferred values for x are 2, 3, or 4. Preferred crystalline sheet silicates of the formula indicated are those in which M denotes sodium and x assumes the value 2 or 3. Both β- and δ-sodium disilicates $Na_2Si_2O_5.yH_2O$ are particularly preferred.

Also included among the preferred builder substances are amorphous sodium silicates having a $Na_2O:SiO_2$ modulus from 1:2 to 1:3.3, preferably 1:2 to 1:2.8, and in particular from 1:2 to 1:2.6, which are dissolution-delayed and exhibit secondary washing properties. The dissolution delay as compared with conventional amorphous sodium silicates can have been brought about in various ways, for example by surface treatment, compounding, compacting/densification, or by overdrying. In the context of this invention, the term "amorphous" is also understood to mean "X-amorphous." In other words, in X-ray diffraction experiments the silicates yield not the sharp X-ray reflections that are typical of crystalline substances, but at most one or more maxima in the scattered X radiation that have a width of several degree units of the diffraction angle. Particularly good builder properties can, however, very easily be obtained even if the silicate particles yield blurred or even sharp diffraction maxima in electron beam diffraction experiments. This may be interpreted to mean that the products comprise microcrystalline regions 10 to several hundred nm in size, values of up to a maximum of 50 nm, and in particular a maximum of 20 nm, being preferred. Densified/compacted amorphous silicates, compounded amorphous silicates, and overdried X-amorphous silicates are particularly preferred.

Usable organic builder substances are, for example, the polycarboxylic acids usable in the form of their sodium salts, "polycarboxylic acids" being understood as those carboxylic acids that carry more than one acid function. These are, for example, citric acid, adipic acid, succinic acid, glutaric acid, malic acid, tartaric acid, maleic acid, fumaric acid, sugar acids, aminocarboxylic acids, nitrilotriacetic acid (NTA), and their descendants, as well as mixtures thereof. Preferred salts are the salts of the polycarboxylic acids such as citric acid, adipic acid, succinic acid, glutaric acid, tartaric acid, sugar acids, and mixtures thereof.

The acids per se can also be used. The acids typically possess not only their builder effect but also the property of an acidifying component, and thus serve also to establish a lower and milder pH for washing or cleaning agents. Citric acid, succinic acid, glutaric acid, adipic acid, gluconic acid, and any mixtures thereof are to be recited in particular in this context. Further acidifying agents that are usable are known pH regulators such as sodium hydrogencarbonate and sodium hydrogensulfate.

Polymeric polycarboxylates are also suitable as builders; these are, for example, the alkali metal salts of polyacrylic acid or of polymethacrylic acid, for example those having a relative molecular weight from 500 to 70,000 g/mol.

The molar weights indicated for the polymeric polycarboxylates are, as has already been explained above, weight-averaged molar weights $M_w$ of the respective acid form that were determined in principle by means of gel permeation chromatography (GPC), a UV detector having been used. The measurement was performed against an external polyacrylic acid standard that, because of its structural affinity with the polymers being investigated, yields realistic molecular weight values. These indications deviate considerably from the molecular weight indications in which polystyrenesulfonic acids are used as a standard. The molar weights measured against polystyrenesulfonic acids are usually much higher than the molar weights indicated in this document.

Polymers suitable as builders are, in particular, polyacrylates that preferably have a molecular weight from 2000 to 20,000 g/mol. Because of their superior solubility, of this group the short-chain polyacrylates that have molar weights from 2000 to 10,000 g/ml, and particularly preferably from 3000 to 5000 g/mol, may in turn be preferred.

Suitable polymers can also encompass substances that are made up partly or entirely of units of vinyl alcohol or derivatives thereof.

Copolymeric polycarboxylates, in particular those of acrylic acid with methacrylic acid and of acrylic acid or methacrylic acid with maleic acid, are also suitable as builders. Copolymers of acrylic acid with maleic acid that contain 50 to 90 wt % acrylic acid and 50 to 10 wt % maleic acid have proven particularly suitable. Their relative molecular weight, based on free acids, is generally 2000 to 70,000 g/mol, by preference 20,000 to 50,000 g/mol, and in particular 30,000 to 40,000 g/mol. The (co)polymeric polycarboxylates can be used as either a powder or an aqueous solution.

To improve water solubility, the polymers can also contain allylsulfonic acids, for example allyloxybenzenesulfonic acid and methallylsulfonic acid, as monomers.

Also particularly preferred are biodegradable polymers made up of more than two different monomer units, for example those that contain as monomers salts of acrylic acid and of maleic acid as well as vinyl alcohol or vinyl alcohol derivatives, or, as monomers, salts of acrylic acid and of 2-alkylallylsulfonic acid, as well as sugar derivatives.

Further copolymers suitable as builders are those that preferably comprise acrolein and acrylic acid/acrylic acid salts, or acrolein and vinyl acetate, as monomers.

Further suitable builder substances are polyacetals, which can be obtained by reacting dialdehydes with polyolcarboxylic acids that comprise 5 to 7 carbon atoms and at least three hydroxyl groups. Preferred polyacetals are obtained from dialdehydes such as glyoxal, glutaraldehyde, terephthalaldehyde and mixtures thereof, and from polyolcarboxylic acids such as gluconic acid and/or glucoheptonic acid.

Further suitable organic builder substances are dextrins, for example oligomers or polymers of carbohydrates, which can be obtained by partial hydrolysis of starches. The hydrolysis can be carried out in accordance with usual, e.g., acid- or enzyme-catalyzed, methods. These are by preference hydrolysis products having average molar weights in the range from 400 to 500,000 g/mol. A polysaccharide having a dextrose equivalent (DE) in the range from 0.5 to 40, in particular from 2 to 30, is preferred, DE being a common indicator of the reducing effect of a polysaccharide as compared with dextrose, which possesses a DE of 100. Both maltodextrins having a DE between 3 and 20, and dry glucose syrups having a DE between 20 and 37, as well as so-called yellow dextrins and white dextrins having higher molar weights in the range from 2000 to 30,000 g/mol, are usable.

The oxidized derivatives of such dextrins are their reaction products with oxidizing agents that are capable of oxidizing at least one alcohol function of the saccharide ring to the carboxylic acid function. These are products oxidized at $C_6$ and/or, with ring opening, at $C_2/C_3$ of the saccharide ring. A product oxidized at $C_6$ of the saccharide ring can be particularly advantageous.

Oxydisuccinates and other derivatives of disuccinates, by preference ethylenediamine disuccinate, are also additional suitable cobuilders. Ethylenediamine-N,N'-disuccinate (EDDS) is preferably used here, in the form of its sodium or magnesium salts. Also preferred in this context are glycerol disuccinates and glycerol trisuccinates. Suitable utilization quantities in zeolite-containing and/or silicate-containing formulations are 3 to 15 wt %.

Other usable organic cobuilders are, for example, acetylated hydroxycarboxylic acids and their salts, which can optionally also be present in lactone form and which contain at least 4 carbon atoms and at least one hydroxy group, as well as a maximum of two acid groups.

The agents can also contain components (so-called soil repellents) that positively influence the ability of oils and fats to be washed out of textiles. This effect becomes particularly apparent when the soiled textile is one that has already been previously washed several times with a washing or cleaning agent according to the present invention that contains this oil- and fat-releasing component. The preferred oil- and fat-releasing components include, for example, nonionic cellulose ethers such as methyl cellulose and methylhydroxypropyl cellulose having a 15 to 30 wt % proportion of methoxy groups and a 1 to 15 wt % proportion of hydroxypropoxyl groups, based in each case on the nonionic cellulose ethers, as well as polymers, known from the existing art, of phthalic acid and/or terephthalic acid and of their derivatives, in particular polymers of ethylene terephthalates and/or polyethylene glycol terephthalates or anionically and/or nonionically modified derivatives thereof. Of these, the sulfonated derivates of phthalic acid polymers and terephthalic acid polymers are particularly preferred.

For use in automatic washing methods, it can be advantageous to add usual foam inhibitors to the agents. Suitable as foam inhibitors are, for example, soaps of natural or synthetic origin that have a high proportion of $C_{18}$ to $C_{24}$ fatty acids. Suitable non-surfactant foam inhibitors are, for example, organopolysiloxanes and mixtures thereof with microfine, optionally silanated silicic acid, as well as paraffins, waxes, microcrystalline waxes, and mixtures thereof with silanated silicic acid or bistearylethylenediamide. Mixtures of different foam inhibitors, for example those made of silicones, paraffins, or waxes, are also used with advantage.

An agent according to the present invention can be solid or liquid. Liquid agents are by preference hydrous. The pH of liquid agents according to the present invention is by preference between 2 and 6, in particular between 3 and 5.5, and particularly preferably between 3.5 and 5. Water can be contained in agents according to the present invention of this kind if desired in quantities of up to 90 wt %, in particular 20 wt % to 75 wt %; the values can optionally also, however, go above or below these ranges. Preferred liquid agents have densities from 0.5 to 2.0 g/cm$^3$, in particular 0.7 to 1.5 g/cm$^3$. The density difference between the phthalimidoperoxyalkanoic acid particles and the liquid phase of the agent is by preference no more than 10% of the density of one of the two, and in particular is so small that the phthalimidoperoxyalkanoic acid particles and, by preference, also other solid particles that may be contained in the agents, float in the liquid phase.

In liquid agents according to the present invention in particular, polydiols, ethers, alcohols, ketones, amides, and/or esters can be used as inorganic solvents, in quantities of up to 80 wt %, by preference 0.1 to 70 wt %, in particular 0.1 to 60 wt %. Low-molecular-weight polar substances such as, for example, methanol, ethanol, propylene carbonate, acetone, acetonylacetone, diacetone alcohol, ethyl acetate, 2-propanol, ethylene glycol, propylene glycol, glycerol, diethylene glycol, dipropylene glycol monomethyl ether, and dimethylformamide, and mixtures thereof, are preferred.

The purpose of graying inhibitors is to keep dirt that has been detached from the fibers suspended in the washing bath, and thus prevent redeposition of the dirt. Water-soluble colloids, usually organic in nature, are suitable for this, for example the water-soluble salts of (co)polymeric carboxylic acids, size, gelatin, salts of ethercarboxylic acids or ethersulfonic acids of starch or of cellulose, or salts of acid sulfuric acid esters of cellulose or of starch. Water-soluble polyamides containing acid groups are also suitable for this purpose. Soluble starch preparations, and starch products other than those cited above, can also be used, for example degraded starch, aldehyde starches, etc. Polyvinylpyrrolidone is also usable. It is preferred, however, to use cellulose ethers such as carboxymethyl cellulose (Na salt), methyl cellulose, hydroxyalkyl cellulose, and mixed ethers such as methylhydroxyethyl cellulose, methylhydroxypropyl cellulose, methylcarboxymethyl cellulose, and mixtures thereof, as well as polyvinylpyrrolidone, for example in quantities from 0.1 to 5 wt % based on the agent.

The agents can contain optical brighteners such as, for example, derivatives of diaminostilbenedisulfonic acid or its alkali metal salts. Suitable, for example, are salts of 4,4'-bis(2-anilino-4-morpholino-1,3,5-triazinyl-6-amino)stilbene-2,2'-disulfonic acid, or compounds of similar structure that carry, instead of the morpholino group, a diethanolamino group, a methylamino group, an anilino group, or a 2-methoxyethylamino group. Brighteners of the substituted diphenylstyryl type can also be present, e.g., the alkali salts of 4,4'-bis(2-sulfostyryl)diphenyl, of 4,4'-bis(4-chloro-3-sulfostyryl)diphenyl, or of 4-(4-chlorostyryl)-4'-(2-sulfostyryl) diphenyl. Mixtures of the aforesaid optical brighteners can also be used.

In addition, UV absorbers can also be used. These are compounds having a pronounced absorption capability for ultraviolet radiation, which, as light protection agents (UV stabilizers), both contribute to improving the light-fastness of dyes and pigments and of textile fibers, and also protect the skin of the wearer of textile products from UV irradiation penetrating through the textile. The compounds that act by radiationless deactivation are generally derivatives of benzophenone, whose substituents (such as hydroxy and/or alkoxy groups) are usually located in the 2- and/or 4-position. Also suitable are substituted benzotriazoles, as well as acrylates phenyl-substituted in the 3-position (cinnamic acid derivatives), optionally with cyano groups in the 2-position, salicylates, organic nickel complexes, and natural substances such as umbelliferone and endogenous urocanic acid. In a preferred embodiment, the UV absorbers absorb UV-A and UV-B radiation as well as, if applicable, UV-C radiation, and radiate back at blue-light wavelengths, so that they additionally have the effect of an optical brightener. Preferred UV absorbers are also triazine derivatives, for example hydroxyaryl-1,3,5-triazine, sulfonated 1,3,5-triazine, o-hydroxyphenylbenzotriazole, and 2-aryl-2H-benzotriazole, as well as bis(anilinotriazinylamino)stilbenesulfonic acid and derivatives thereof. Pigments such as titanium dioxide that absorb ultraviolet radiation can also be used as UV absorbers.

Liquid agents according to the present invention can contain, if desired, usual thickening agents and anti-settling agents, as well as viscosity regulators such as polyacrylates, polycarboxylic acids, polysaccharides and derivatives thereof, polyurethanes, polyvinylpyrrolidones, castor oil derivatives, polyamine derivatives such as quaternized and/or ethoxylated hexamethylenediamines, and any mixtures thereof. Preferred liquid agents contain xanthan gum as a thickening agent and exhibit, in measurements with a Brookfield viscosimeter at a temperature of 20° C. and a shear rate of 20 min$^{-1}$, a viscosity between 100 and 10,000 mPa·s.

Liquid agents according to the present invention can also be made up of at least two, by preference exactly two, subcompositions, held separately from one another, that are present separately from one another in a multi-chamber receptacle, wherein a water-containing dispersion of the particulate phthalimidoperoxyalkanoic acid, which contains an active substance selected from the group encompassing Zn ions, phosphonocarboxylic acids, phosphonic acids, phosphates, polyaspartic acids, fatty amines, surfactants having nitrogen-containing head groups, and mixtures thereof, is present in one chamber, and the other ingredients of the completed washing- or cleaning-agent composition are present in the second chamber or the further chambers. The corrosion-inhibiting active substances can in principle also be contained in the second chamber, i.e., not in the same chamber in which the dispersion of particulate phthalimidoperoxyalkanoic acid is contained.

The agents can contain further typical washing- and cleaning-agent constituents such as perfumes and/or dyes, those dyes that have no or negligible coloring effect on the textiles to be washed being preferred. Preferred quantitative ranges for the totality of the dyes used are less than 1 wt %, by preference less than 0.1 wt %, based on the agent. The agents can, if applicable, also contain white pigments such as, for example, $TiO_2$.

A further subject of the invention is the use of a water-containing dispersion of a particulate phthalimidoperoxyalkanoic acid, which contains polycarboxylates as well as organic phosphonic acids and/or salts thereof, for the manufacture of, in particular, liquid washing or cleaning agents.

A further subject of the invention is a textile washing method in an automatic washing machine, using a bleaching agent-containing washing or cleaning agent containing a particulate phthalimidoperoxyalkanoic acid and also polycarboxylates as well as organic phosphonic acids and/or salts thereof, wherein (a) the polycarboxylates are present in the washing bath at concentrations of at least 40 ppm, advantageously in the range from 50 ppm to 500 ppm, by preference from 100 ppm to 400 ppm, in particular from 150 ppm to 300 ppm, and (b) the organic phosphonic acids and/or salts thereof are present in the washing bath at concentrations of at least 2 ppm, advantageously in the range from 5 ppm to 300 ppm, by preference from 10 ppm to 250 ppm, in particular from 20 ppm to 200 ppm, and (c) the particulate phthalimidoperoxyalkanoic acid is present in the washing bath at concentrations of at least 5 ppm, advantageously in the range from 10 ppm to 400 ppm, by preference from 20 ppm to 300 ppm, in particular from 30 ppm to 200 ppm.

A further subject of the invention consists in the use of a water-containing dispersion of a particulate phthalimidoperoxyalkanoic acid, which contains an active substance selected from the group encompassing Zn ions, benzotriazole, nitrate ions, phosphonocarboxylic acids, phosphonic acids, phosphates, polyaspartic acids, fatty amines, surfactants having nitrogen-containing head groups, and mixtures thereof, and if applicable additionally polycarboxylate, for the manufacture of, in particular, liquid washing or cleaning agents.

A further subject of the invention consists in the use of an active substance selected from the group encompassing Zn ions, benzotriazole, nitrate ions, phosphonocarboxylic acids, phosphonic acids, phosphates, polyaspartic acids, fatty amines, surfactants having nitrogen-containing head groups, and mixtures thereof, if applicable mixed additionally with polycarboxylate, to suppress corrosion phenomena on machine parts in the context of textile laundering in an automatic washing machine in the context of the use of phthalimidoperoxyalkanoic acid-containing washing agents.

EXAMPLES

Example 1

Agents E1 And E2 According To the Present Invention

The liquid washing agent E1 according to the present invention was an odorant- and surfactant-containing liquid washing agent that was adjusted to a pH of 5.0 and had a total surfactant content (anionic and nonionic surfactant) of about 27 wt %. E1 further contained 2.5 wt % PAP granulate (Eureco®, Solvay), as well as 2 wt % hydroxyphosphonoacetic acid (BioLab Water Additives) ("wt %" being based in each case on the entire agent). In addition to water, it further contained sodium sulfate, sodium citrate, and complexing agents, as well as foam inhibitor and thickener. No further bleaching agents other than the PAP granulate were contained.

The liquid washing agent E2 according to the present invention was an odorant- and surfactant-containing liquid washing agent that was adjusted to a pH of 5.0 and had a total surfactant content (anionic and nonionic surfactant) of about 27 wt %. E2 further contained 2.5 wt % PAP granulate (Eureco®, Solvay), as well as 0.6 wt % of a phosphonic acid (Aquacid 1084 EX, Aquapharm Chemical, India) and 3 wt % polyacrylic acid sodium salt, $M_w$ 4000 g/mol (Sokalan PA 25 CL, BASF) ("wt %" being based in each case on the entire agent). In addition to water, it further contained sodium sulfate, sodium citrate, and complexing agents, as well as foam inhibitor and thickener. No further bleaching agents other than the PAP granulate were contained.

Example 2

Comparison Examples V1 And V2

Agent V1 corresponded to agent E1, with the difference that V1 contained no phosphonic acid. Agent V2 corresponding to agent E2, with the difference that V2 contained neither phosphonic acid nor polyacrylate. These absent constituents were replaced with water.

Example 3

Comparison Example V3

Agent V3 corresponded to agent V2, with the difference that V3 contained no PAP granulate. This constituent was replaced with water.

Example 4

Performing the Corrosion Investigations

Corrosion investigations were carried out with the products V1, V2, V3, E1, and E2 described above at a dosage of 80 g per 15 l of water, in the following ways:

Practical experiment: In a washing machine manufactured by BSH, 50 washing cycles of a 60° C. colored washing program were executed using 3.5 kg of filling laundry; the heating element and its mount were then removed and investigated visually for traces of corrosion. The heating element is made of Nirosta® 4301 stainless steel that is coated with a nickel layer; the mount is likewise made of Nirosta® 4301.

Model experiment: A heating element manufactured by BSH and equipped with a control apparatus (the heating element is made of Nirosta® 4301 that is coated with a nickel layer; the mount is made, according to an XPS analysis, of a nickel-free chromium stainless steel), along with the corresponding mount, was installed in a horizontal position near the bottom in a stainless-steel vessel holding 17 liters of water and having a stirring device This vessel was loaded 50 times, for 1 hour each, with the respective fresh washing liquors of the products to be tested. The temperature was raised to 70° C. and held constant using the heating element. The heating element along with the mounts was then removed and investigated visually for traces of corrosion.

The pH of the washing baths was 7.0 in each case.

Results:

When the comparison formulations V1 or V2 were used, detectable traces of corrosion in the form of a brown halo around the nickel/stainless steel contact point on the heating element mount were already evident in the model experiment after 10 washing cycles. After 50 cycles, in the practical experiment and in the model experiment, the nickel layer of the heating element had detached in the region of the heating element mount and the holder was distinctly rusty. In addition, smaller rust traces were detectable at other locations on the heating element. In the model experiment, a definite brown coloration and rough areas were visible around the nickel/stainless steel contact point.

No corrosion at all was detectable with the use of comparison formulation V3. In the practical experiment and in the model experiment, the heating element was substantially still bright after 50 washing cycles.

With the use of the formulations E1 or E2 according to the present invention, the nickel/stainless steel contact point was completely free of traces of corrosion after 50 cycles, in the model experiment and also in the practical experiment.

What is claimed is:

1. A bleaching agent-containing washing or cleaning agent comprising:

a) at least one particulate phthalimidoperoxyalkanoic acid;

b) Zn ions;

c) a phosphonocarboxylic acid.

2. The agent according to claim 1, additionally comprising at least one active substance selected from the group consisting of benzotriazole, nitrate ions, phosphonic acids, phosphates, polyaspartic acids, fatty amines, and surfactants having nitrogen-containing head groups.

3. The agent according to claim 1, comprising 0.5 wt % to 25 wt % phthalimidoperoxyalkanoic acid.

4. The agent according to claim 1, wherein the phthalimidoperoxyalkanoic acid is 6-phthalimidoperoxyhexanoic acid (PAP).

5. The agent according to claim 1, comprising 0.05 wt % to 4 wt % zinc salt.

6. The agent according to claim 1, comprising 0.2 wt % to 2 wt % zinc salt.

7. The agent according to claim 1, comprising up to 10 wt % phosphonocarboxylic acid.

8. The agent according to claim 1, additionally comprising up to 10 wt % phosphonic acid.

9. The agent according to claim 1, additionally comprising 0.5 wt % to 15 wt % polycarboxylate.

10. The agent according to claim 1, additionally comprising 0.5 wt % to 15 wt % polyacrylate.

11. The agent according to claim 1, additionally comprising a mixture of anionic and nonionic surfactants.

12. The agent according to claim 1, additionally comprising 0.1 wt % to 50 wt % surfactant.

13. The agent according to claim 1, wherein the agent is liquid and has a pH in the range from 2 to 6.

14. The agent according to claim 13, wherein the densities of the phthalimidoperoxyalkanoic acid particles and of the liquid phase of the agent differ from one another by no more than 10%.

15. The agent according to claim 1, wherein the agent is liquid and is made up of at least two subcompositions, held separately from one another, that are present separately from one another in a multi-chamber receptacle, such that a water-containing dispersion of the particulate phthalimidoperoxyalkanoic acid, which comprises Zn ions, is present in one chamber, and one or more other ingredients of the completed washing- or cleaning-agent composition are present in a second chamber or further chambers.

16. The agent according to claim 1, wherein the Zn ions are introduced in the form of one or more water-soluble Zn salts selected from the group consisting of zinc acetate, zinc nitrate and zinc sulfate.

17. The agent according to claim 1, comprising:

a) 0.5 wt % to 25 wt % phthalimidoperoxyalkanoic acid;

b) 0.05 wt % to 4 wt % zinc salt;

c) up to 10% phosphonocarboxylic acid, and d) at least one active substance selected from the group consisting of phosphonic acids, polycarboxylates, and 0.1 wt % to 50 wt % surfactant, wherein the agent is liquid and has a pH in the range from 2 to 6.

18. The agent according to claim 1, comprising:

a) 1 wt % to 20 wt % phthalimidoperoxyalkanoic acid selected from the group consisting of 6-phthalimidoperoxyhexanoic acid;

b) 0.2 wt % to 2 wt % zinc salt;

c) 2 wt % to 4 wt % phosphonocarboxylic acid, and d) at least one active substance selected from the group consisting of phosphonic acids, polycarboxylates, and 10 wt % to 40 wt % surfactant, wherein the agent is liquid and has a pH in the range from 3 to 5.5, and the densities of the 6-phthalimidoperoxyhexanoic acid particles and of the liquid phase of the agent differ from one another by no more than 10%.

19. A method of making a liquid washing or cleaning agent according to claim 1, comprising preparing a water-containing dispersion of a particulate phthalimidoperoxyalkanoic acid, wherein the water-containing dispersion further comprises the Zn ions.

20. A method of suppressing corrosion phenomena on machine parts in the context of textile laundering in an automatic washing machine, comprising laundering said textiles in an automatic washing machine with the composition of claim 1.

* * * * *